US006663397B1

(12) United States Patent
Lin et al.

(10) Patent No.: US 6,663,397 B1
(45) Date of Patent: Dec. 16, 2003

(54) ELECTRICAL CONNECTOR

(75) Inventors: Hsien-Chu Lin, Tu-Chen (TW); Lung-Sheng Tai, Tu-Chen (TW); Chia-Ming Kuo, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/310,361

(22) Filed: Dec. 4, 2002

(30) Foreign Application Priority Data

Sep. 25, 2002 (TW) ..... 91215141 U

(51) Int. Cl.[7] ..... H01R 12/00

(52) U.S. Cl. ..... 439/63; 439/154; 439/301; 439/475; 439/581

(58) Field of Search ..... 439/63, 154, 578, 439/581, 675, 353, 301, 475

(56) References Cited

U.S. PATENT DOCUMENTS 4,863,397 A * 9/1989 Hatch, Jr. ..... 439/475
5,074,809 A 12/1991 Rousseau
5,611,707 A 3/1997 Meynier
6,511,341 B1 * 1/2003 Finona et al. ..... 439/475

FOREIGN PATENT DOCUMENTS

JP 1-187784 * 7/1989 ..... 439/475

* cited by examiner

*Primary Examiner*—Tho D. Ta
(74) *Attorney, Agent, or Firm*—Wei Te Chung

(57) ABSTRACT

An electrical connector (1) mates with a complementary connector (2) for transmitting signals. The electrical connector includes a first shell (10), a first conductive contact (12) and a first insulative housing (11) sandwiched between the first shell and the first contact for retaining the first contact. An engaging portion (102) protrudes from the first shell for engaging with the complementary connector. The engaging portion has an engaging surface (106) perpendicular to an outer surface of the first shell. The first shell includes a slot (103) defined therein and around the axes of the first shell.

1 Claim, 4 Drawing Sheets

ELECTRICAL CONNECTOR

BACKGROUND OF THE INVENTION

1. Field of the Invention

The present invention generally relates to an electrical connector, and more particularly to an electrical connector permanently mating with a complementary connector.

2. Description of Prior Art

Microminiature coaxial (MCX) connectors generally act as antenna connectors to connect antennas with transmitters. A conventional MCX connector mates with a complementary connector by snap-on or screw. U.S. Pat. No. 5,611,707, issued to Meynier on Mar. 18, 1997, and U.S. Pat. No. 5,074,809, issued to Rousseau on Dec. 24, 1991, each discloses a MCX connector having a locking portion to mate with a complementary connector. Each locking portion includes orbicular or incline configuration for easily inserting into, pulling out and engaging in the complementary connector. Therefore, these conventional MCX connectors can repeatedly mate with the complementary connectors.

According to Title 47 of Code of Federal Regulation (CFR) 15.203 and a public notice DA 00-1087 issued by Federal Communications Commission (FCC) on May 22, 2000, an intentional radiator shall be designed to ensure that no antenna other than that furnished by the responsible party shall be used with the transmitter. Typically, a manufacturer will either design a unique antenna connector or modify a commonly available connector to satisfy this requirement.

However, to a manufacturer, a unique antenna connector design may be expensive or unacceptable in the market, so a commonly available antenna connector for permanent mating will be a better way.

Hence, an improved MCX connector is needed to eliminate the above-mentioned defects of the conventional MCX connectors.

BRIEF SUMMARY OF THE INVENTION

A main object of the present invention is to provide an electrical connector with a locking portion for permanently mating with a complementary connector.

Another object of the present invention is to provide an electrical connector with a relative flimsy portion preventing the electrical connector being mated again.

An electrical connector according to the present invention mates with a complementary connector for transmitting signals. The electrical connector includes a first shell, a first conductive contact and a first insulative housing sandwiched between the first shell and the first contact for retaining the first contact. An engaging portion protrudes from the first shell for engaging with the complementary connector. The engaging portion has an engaging surface perpendicular to an outer surface of the first shell. The first shell includes a slot defined therein and around the axes of the first shell.

Other objects, advantages and novel features of the invention will become more apparent from the following detailed description of a preferred embodiment when taken in conjunction with the accompanying drawings.

DETAILED DESCRIPTION OF THE INVENTION

Figure 1:
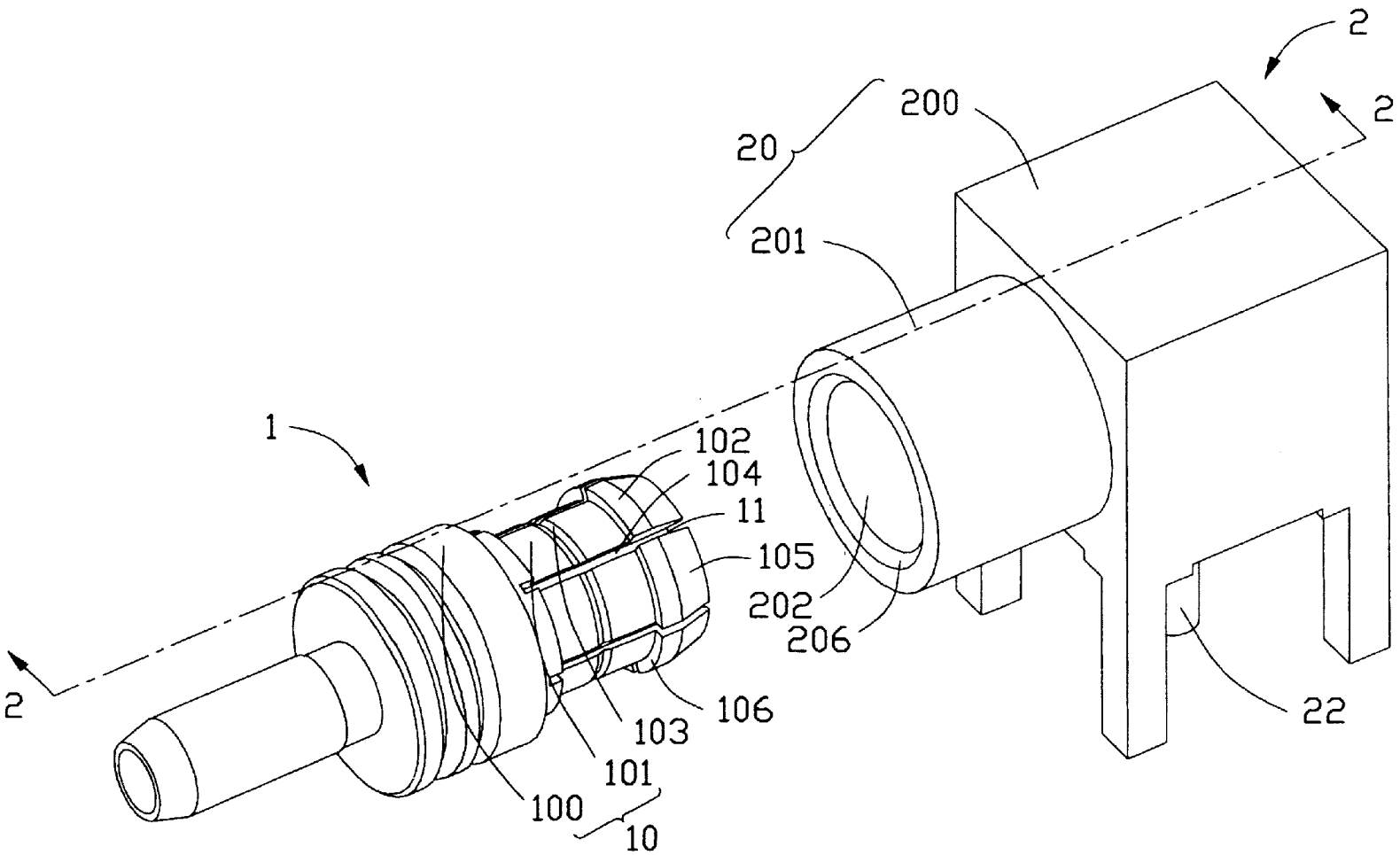
FIG. 1 is a perspective view of an electrical connector of the present invention and a complementary connector, before mating with each other.
Figure 2:
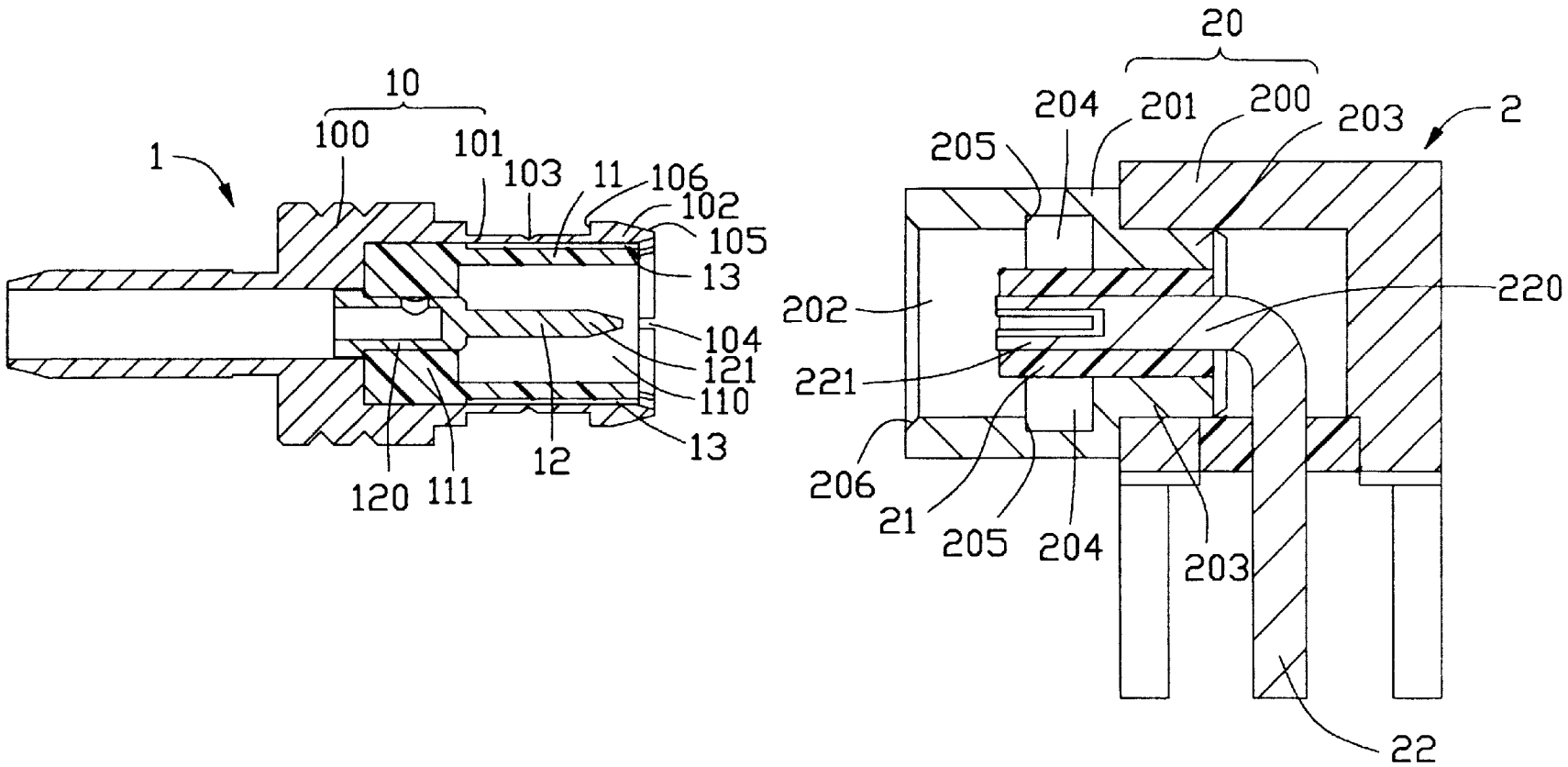
FIG. 2 is a cross-sectional view taken along a line 2—2 of FIG. 1.
Figure 3:
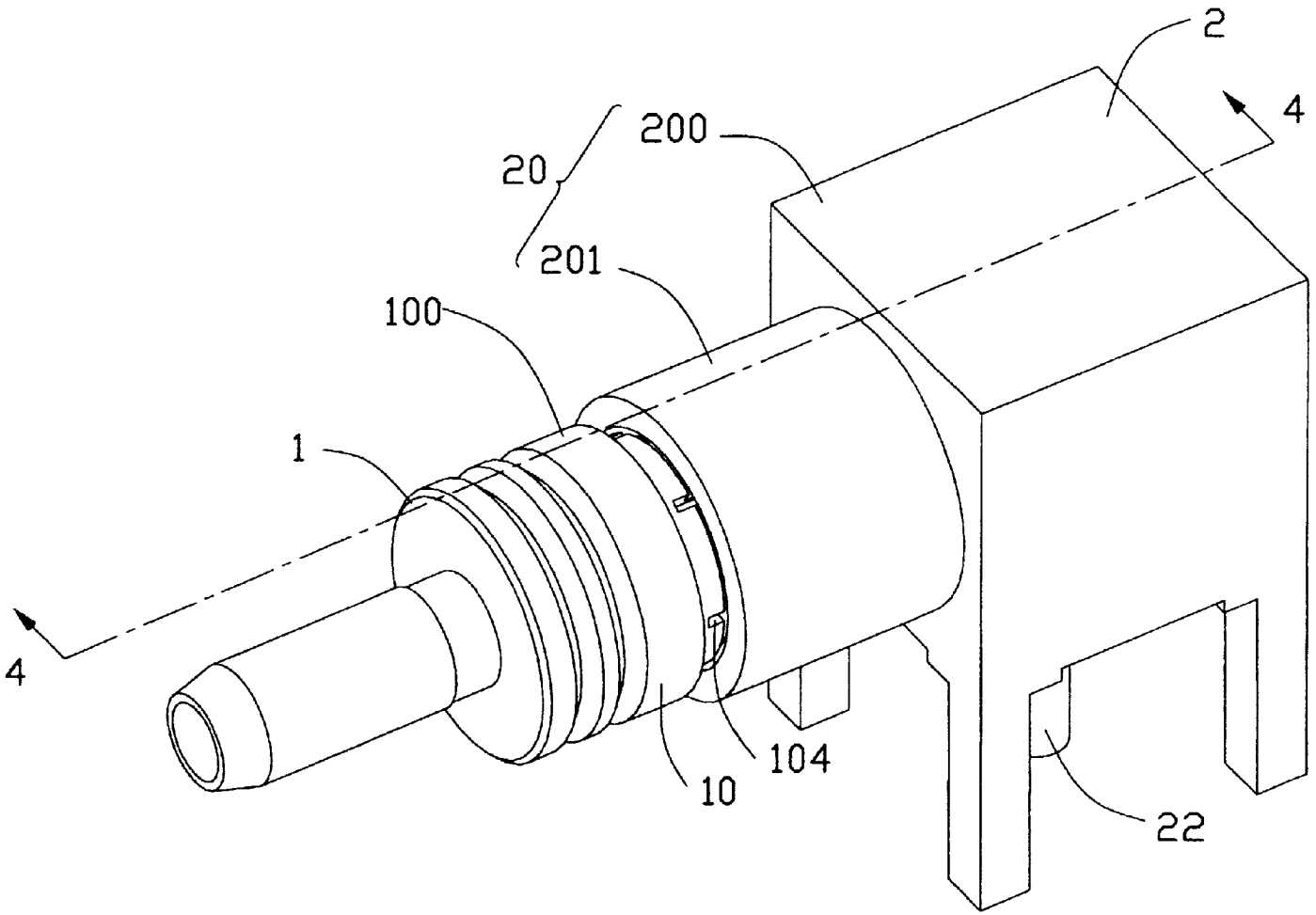
FIG. 3 is perspective view of the electrical connector and the complementary connector of FIG. 1 in a mated state.
Figure 4:
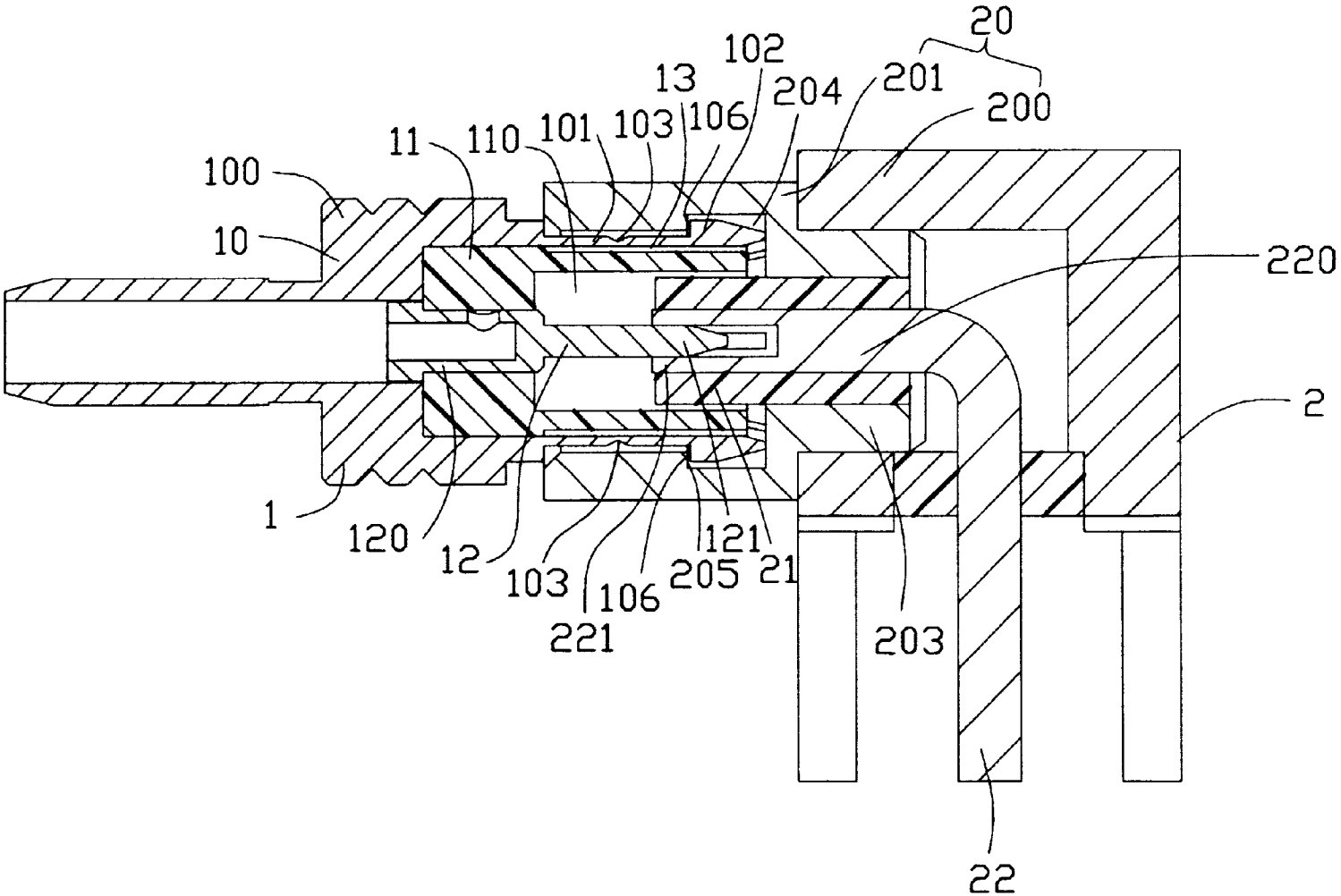
FIG. 4 is a cross-sectional view taken along a line 4—4 of FIG. 3.

Referring to FIGS. 1 and 2, an electrical connector 1 of the present invention for mating with a complementary connector 2, comprises a hollow cylindrical first shell 10, a first contact 12 received in the first shell 10 and an insulative first housing 11 between the first shell 10 and the first contact 12 for holding the first contact 12.

The first shell 10 is metallic and includes a first base portion 100 and a mating portion 101 extending from the base portion 100. A plurality of grooves 104 are defined through the mating portion 101, each groove 104 parallel to the axes of the first shell 10. A slot 103 is defined in an outer surface of a medial portion of the mating portion 101 and in a circle around the axes of the first shell 10. An engaging portion 102 protrudes outwardly from a free end of the mating portion 101. The engaging portion 102 has an engaging surface 106 adjacent to the slot 103 and a declining leading surface 105 away from the slot 103. The engaging surface 106 is perpendicular to the out surface of the mating portion 101.

The first housing 11 is fixed in the first shell 10 and defines a first receiving cavity 110. The first housing 11 has a body portion 111 engaging with the first base portion 100 and retaining the first contact 12. An aperture 13 is defined between the mating portion 101 and the first housing 11.

The first contact 12 includes a first mounting portion 120 retained by the body portion 111 of the first housing 11 and a first contacting portion 121 extending from the first mounting portion 120 into the first receiving cavity 110.

The complementary connector 2 comprises a hollow cylindrical second shell 20, a second contact 22 received in the second shell 20 and an insulative second housing 21 between the second shell 20 and the second contact 22 for holding the second contact 22.

The second shell 20 is metallic and includes a second base portion 200 and a sleeve portion 201 partially retained in the second base portion 200. The sleeve portion 201 defines a second receiving cavity 202 and has a tail portion 203 retained by the second base portion 200 and engaging with the second housing 21. A holding slot 204 is defined in an inner surface of the sleeve portion 201 adjacent to the tail portion 203, and a holding plane 205 is formed in the holding slot 204 and perpendicular to the inner surface of the sleeve portion 201. The sleeve portion 201 includes a declining recess 206 in a free end thereof away from the tail portion 203. The inside diameter of the sleeve portion 201 is slightly less that the outside diameter of the engaging portion 102.

The second housing 21 engaging with the tail portion 203 extends into the second receiving cavity 202 and retains the second contact 22 therein. The second contact 22 includes a second mounting portion 220 and a tuning-fork shaped second contacting portion 221 engaging with the second housing 21.

Referring to FIGS. 1–4, in mating process, the mating portion 101 of the electrical connector 1 is inserted into the second receiving cavity 202 of the complementary connector 2. Under the leading of the declining leading surface 105 and the declining recess 206, the mating portion 101 is slightly bent inwardly by the inner surface of the sleeve portion 201. After the electrical connector 1 is entirely inserted into the complementary connector 2, the first contact 12 mechanically and electrically connects with the second contact 22, and the engaging portion 102 is received in the holding slot 204. The engaging surface 106 is retained by the holding plane 205, thereby ensuring the electrical connector 1 cannot be pulled out.

The retention force between the engaging surface 106 and the holding plane 205 is larger than the crack force at the slot 103 of the electrical connector 1 and the retention force between the tail portion 203 and the second base portion 200 of the complementary connector 2. When a user intends to pull out the electrical connector 1 from the complementary connector 2 with a strong hand, the first shell 10 of the electrical connector 1 will break along the slot 103, or the sleeve portion 201 will be pulled out of the second base portion 200 of the complementary connector 2, thereby destroying the structure of the electrical connector 1 or the complementary connector 2 to prevent the connectors 1 and 2 being used again.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted to mating with a complementary connector, comprising:

a metallic shell, comprising: a base portion; and a mating portion extending from the base portion, including an engaging portion and a depressed portion defined in the mating portion between the base portion and the engaging portion;

an insulative housing received in the shell; and a conductive contact retained in the housing;

wherein the shell is substantially hollow cylindrical shaped, the base portion is rigid and the mating portion is semi-rigid;

wherein the engaging portion protrudes on a free end of the mating portion, and the depressed portion is defined in a medial portion of the mating portion, both the engaging portion and the depressed portion arranged around the axes of the shell;

wherein the engaging portion permanently mates with the complementary connector;

wherein at least a slot circumferentially formed in the depressed portion;

wherein the shell is relatively flimsy at the depressed portion so that any intention of disengagement/separation under a larger outside force between the connector and the complementary connector, will only result in self-breaking or self-splitting at the slot.

* * * * *